United States Patent [19]

Ipcinski

[11] Patent Number: 5,068,505

[45] Date of Patent: Nov. 26, 1991

[54] ALTERNATE ACTION PUSHBUTTON SWITCH

[75] Inventor: Ralph Ipcinski, Hollis, N.H.

[73] Assignee: C & K Components Inc., Newton, Mass.

[21] Appl. No.: 614,241

[22] Filed: Nov. 16, 1990

[51] Int. Cl.[5] ..... H01H 13/56
[52] U.S. Cl. ..... 200/525
[58] Field of Search ..... 200/525, 529

[56] References Cited

U.S. PATENT DOCUMENTS 3,619,528 11/1971 Sorenson ..... 200/525 X
4,095,070 6/1978 Simpson ..... 200/525

*Primary Examiner*—Renee S. Luebke

[57] ABSTRACT

This is an electric switch utilizing a cam which has a pair of spaced springs bearing against the movable contact. The switch operates by applying pressure to a camming surface which compresses one of the springs and causes the movable contact to shift from one position to another.

3 Claims, 2 Drawing Sheets

ALTERNATE ACTION PUSHBUTTON SWITCH

BACKGROUND OF THE INVENTION

This invention relates generally to a switch and more specifically to an alternate action push-button switch.

SUMMARY OF THE INVENTION

An alternate action push-button switch comprising a plunger, a bushing, actuation means, a return spring, a cam, spring means and a movable contact. The plunger is movably mounted in the bushing and engages the actuation means. The actuation means is adapted to contact the cam and the cam has the spring means positioned therewith. The spring means engages the movable contact whereby activating the plunger will cause the acutation means to engage the cam shifting the movable contact from one position to another.

BRIEF DESCRIPTION OF THE DRAWINGS

Further details are explained below with the help of the example(s) illustrated in the attached drawings in which.

DESCRIPTION OF THE PREFERRED EMBODIMENT(S)

Figure 1:
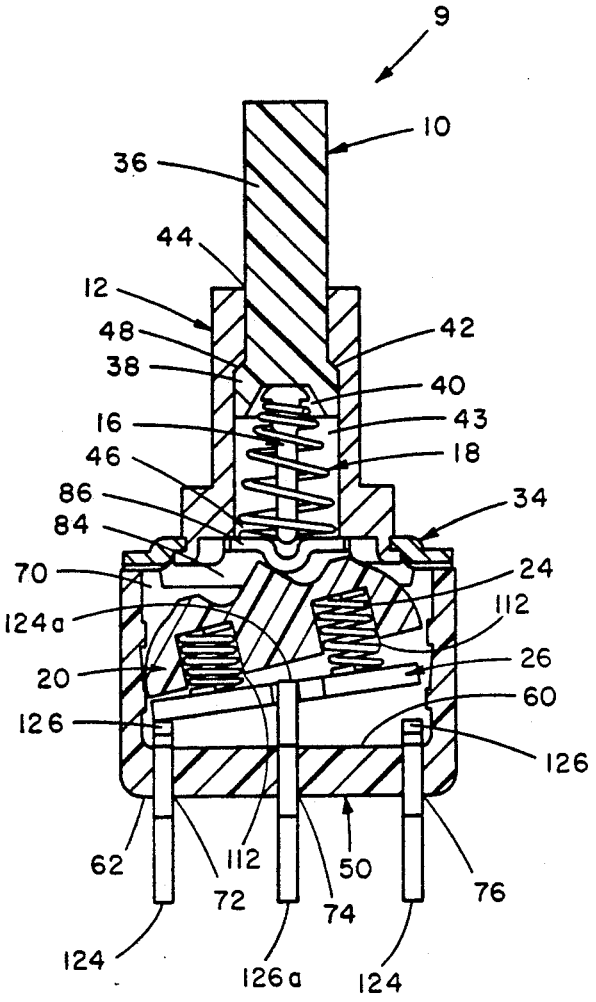
FIG. 1. is a cross sectional view of the alternate action push-button switch according to the present invention.

There is shown in the drawings a snap-action, alternate action push-button switch 9 comprising a plunger 10, a bushing 12, housing 14, a pawl pin 16, a return spring 18, a cam 20, first and second contact springs 22, 24, a movable contact 26, first and second contact terminals 28, 32, a center contact terminal 30 and a bracket 34.

The plunger 10 comprises a cylindrical shank portion 36 having an integral mating terminal end 38. The mating terminal end 38 includes a coaxially positioned depression 40 and a shoulder 42 formed on the exterior of the mating terminal end 38 and spaced from the opening into the depression 40 as shown in FIG. 1 .

The bushing 12 has an axial passage 43 extending longitudinally through its first and second terminal ends 44, 46. An angled, inner peripheral shoulder portion 48 is formed on the wall defining the passage 43 in close proximity to the second terminal end 46.

The plunger 10 is assembled with the bushing 12, by passing the shank portion 36 through the first terminal end 44 of the passage 43, thence through the passage 43 and through the second terminal end 46 of the passage 43. The shoulder 42 of the plunger 10 is butted against the shoulder portion 48 of the passage 43. In this position, the major length of shank portion 36 of the plunger 10 extends beyond the area defined by the bushing 12.

The housing 14 includes a base 50 having a first short side edge 52, a second short side edge 54, a first long side edge 56 and a second long side edge 58. The first and second short side edges 52, 54 are in spaced parallel relation with each other and connected at their ends by the first and second long side edges 56, 58. The base 24 also includes an upper surface 60 and a lower surface 62. A first side wall 64 extends from the first short side edge 52 and a second side wall 66 extends from the second short side edge 54 in right angle relation to the first side wall 52. A third side wall 68 extends from the first long side edge 56 and a fourth side wall 70 extends from the second long side edge 58. The fourth and second side walls 70, 66 connect the first and third side walls 64, 68 and are in spaced parallel relation to each other, as are the first and third side walls 64, 68. First, second and third slots 72, 74, 76 are formed through the base 50. The first slot 72 is formed adjacent the first side wall 64 and the third slot 76 is formed adjacent the second side wall 66. The second slot 74 is formed centrally between the first and second slots 72, 74.

The bracket 34 comprises a base portion 80 having two side edges from one of which a first wing 82 extends and from the other of which a second wing 84 extends in spaced, parallel relation with the first wing 82. A stamped detent 86 is provided on each wing 82, 84 adjacent its connection with its respective side edge.

Figure 2:
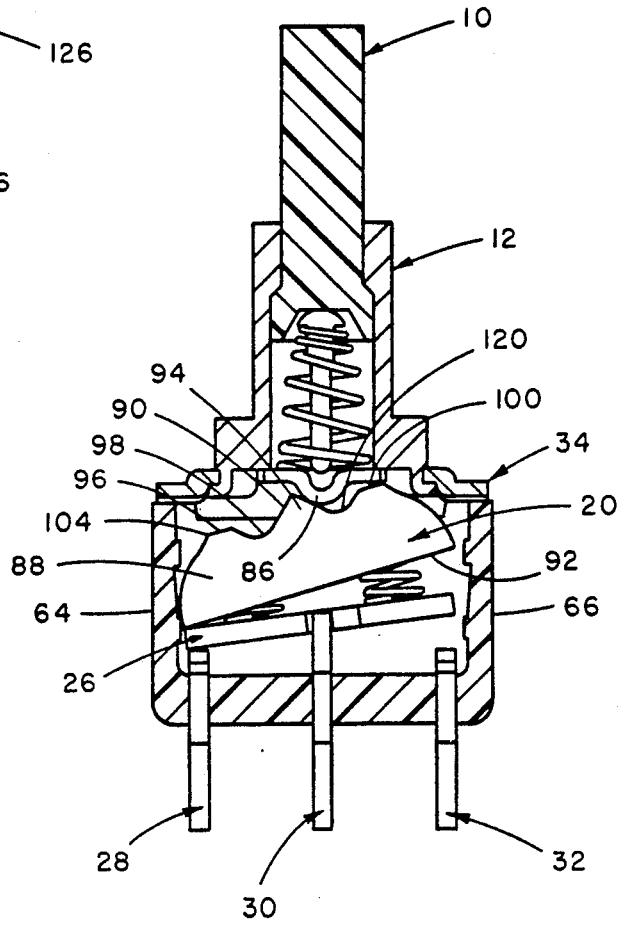
FIG. 2. is a cross sectional view of the alternate action push-button switch, with the cam shown in side elevation, as shown in FIG. 1.
Figure 3:
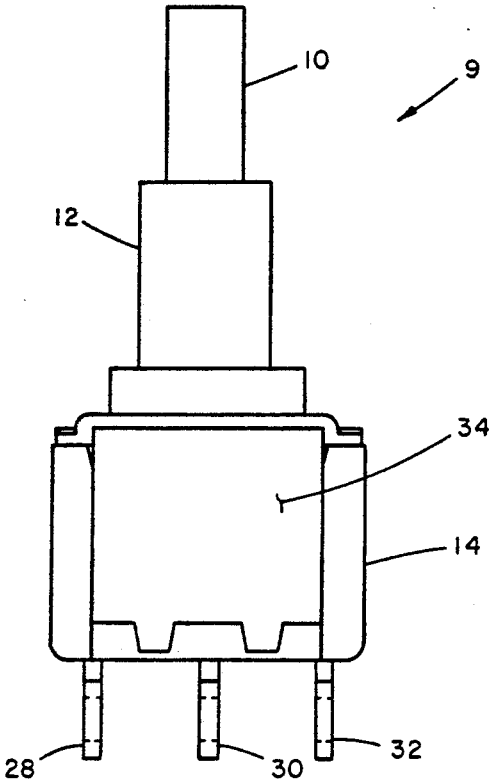
FIG. 3 is a side elevational view of the alternate action push-button switch shown in FIG. 1.
Figure 7:
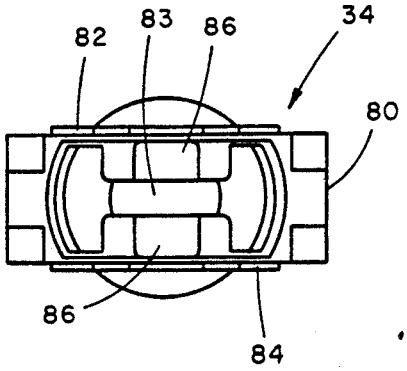
FIG. 7 is a plan view of the bracket of the alternate action push-button switch shown in FIG. 1.
Figure 5:
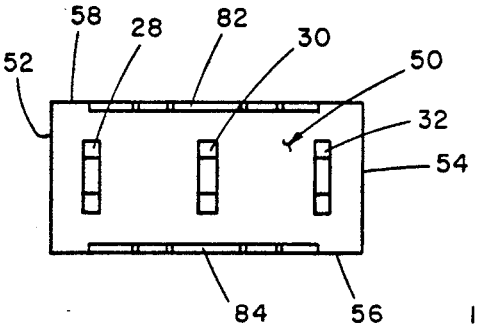
FIG. 5 is a top plan view of the base of the the housing of the alternate action push-button switch shown in FIG. 1.
Figure 4:
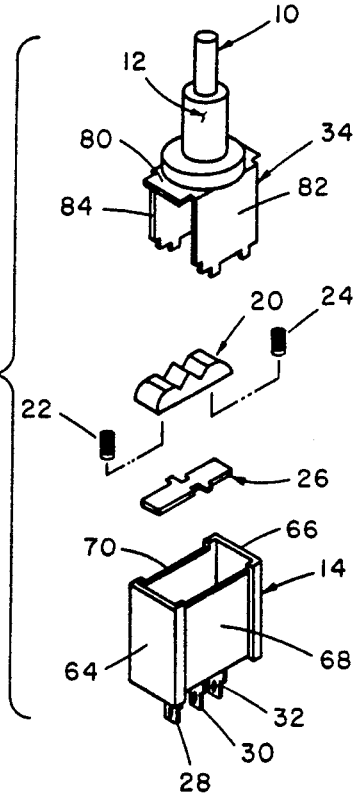
FIG. 4 is an exploded perspective view of the of the alternate action push-button switch shown in FIG. 1.
Figure 6:
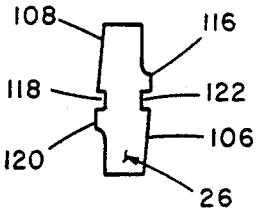
FIG. 6 is a top plan view of the movable contact of the alternate action push-button switch shown in FIG. 1.
Figure 8:
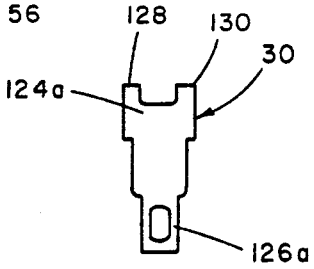
FIG. 8 is a side elevational view of the center contact terminal of the alternate action push-button switch shown in FIG. 1.

The cam 20 comprises a unitary, shaped body portion 88 having a top surface 90 and a bottom surface 92. The top surface 90 includes a central apex 94 having a first land 96 spaced from the central apex 94 by a first indent 98 and a second land 100 spaced from the central apex 94 by a second indent 102 all as shown in FIGS. 1, 2, and 4. The bottom surface 92 is spaced from and generally parallel with the topmost portion 104 of the first and second lands 96, 100. The bottom surface 92 has a pair of spaced blind apertures 112 formed therein.

The movable contact 26 is rectangular and planar in configuration and is formed of a electrically conductive material. The movable contact 26 has a first long side edge 106 and a second long side edge 108. A shallow first hollow 118 is formed at the midpoint of the second long side edge 108 and a shallow second hollow 122 is formed at the midpoint of the second long side edge 106 in opposed relation to the first hollow 118. A first rectangular projection 116 extends from the first long side edge 106 adjacent a side of the second hollow 122 and a second rectangular projection 120 extends from the second long side edge 108 adjacent a side of the first hollow 118 opposite from that from which the first rectangular projection 116 extends.

Each of the first and second contact terminals 28, 32 consist of a rectangular body portion having a first free terminal end 124 and a second free terminal end 126. The second free terminal end 126 has an aperture formed in close proximity thereto through the body portion. The center contact terminal 30 consists of a rectangular body portion having a prime free terminal end **124*a* and a secondary free terminal end 126*a*. The prime free terminal end 124*a* includes a pair of end posts 128, 130** which are spaced from each other and define a rectangular slot.

To assembly the push-button switch 9, the first contact terminal 28 is passed through the first slot 72 in the base 50 of the housing 14 with its terminal end 124 positioned external of the housing 14. The second contact terminal 32 is passed through the third slot 76 in the base 50 of the housing 14 with its free terminal end 126 positioned external of the housing 14. The center contact terminal 30 is passed through the third slot 76 in the base 50 of the housing 14 with its secondary free terminal end **126*a* positioned external of the housing 14 with its prime free terminal end 124*a* positioned within the housing 14 on a horizontal plane above the horizontal plane on which the terminal end of the first and second contact terminals 28, 32 lie. The second contact terminal 32 is passed through the second slot 74 in the base 50 of the housing 14 with its second free terminal end 126*a* positioned external of the housing 14. The first, second and center contact terminals 28, 32, 30 are staked or epoxied to the base 50. The center contact terminal 30 is mounted placing the prime free terminal end 124*a* within the cavity defined by the housing 14 with the pair of end posts 128, 130 directed toward the open end of the housing 14. The movable contact 26 is positioned on the prime free terminal end 124*a* with one of the end posts 128 placed in the first hollow 118 and the other of the end posts 130 placed in the second hollow 122. The housing 14, with the first, second and center contact terminals 28, 32, 30** forming a sub assembly.

The first contact spring 22 is positioned in one of the blind apertures 112 of the cam 20 and the second contact spring 24 is positioned in the other blind aperture 112. The bottom surface 92 of the cam 20 is placed on the movable contact 26. The pawl pin 16 is inserted in the passage 43 of the shank portion 36 of the plunger 10 with a terminal end positioned in the depression 40 of the plunger 10 as shown in FIG. 1. The return spring 16 is placed within the passage 43 in spaced circumscribed relation with the pawl pin 16. The plunger 10 is assembled with the bushing 12, by passing the shank portion 36 through the first terminal end 44 of the passage 43, thence through the passage 43 and through the second terminal end 46 of the passage 43. The shoulder 42 of the plunger 10 is butted against the shoulder portion 48 of the passage 43. In this position, the major length of shank portion 36 of the plunger 10 extends beyond the area defined by the bushing 12.

The plunger 10 comprises a cylindrical shank portion 36 having an integral mating terminal end 38. The mating terminal end 38 includes a coaxially positioned depression 40 and a shoulder 42 formed on the exterior of the mating terminal end 38 and spaced from the opening into the depression 40 as shown in FIG. 1. The bracket or top plate 34 is staked to the bushing 12 holding the assembly of the plunger 10, the pawl pin 16 and the return spring 18 together. The terminal end of the pawl pin 16 remote from the plunger 10 is directed toward the aperture 83 in the bracket 34 and held spaced from the bracket 34 by the return spring 18. The bracket 34 is also staked to the open end of the housing 14 holding the subassembly of the first and second contact terminals 28, 32, center contact terminal 30, the cam 20 with its associated contact springs 22, 24.

In operation the user would depress the plunger 10 which in turn depresses the pawl pin 16 and return spring 18 causing the free terminal end of the pawl pin 16 to pass through the aperture 83 of the bracket 34 and bear against a cam surface on one side of the central apex 94 as does the detent 86 of the bracket 34. This action pushes the first and second contact springs 22, 24 and the cam 20 toward the base 50 of the housing 14. The cam 20 continues to move toward the base 50 until there is clearance between the central apex 94 and the detent 86. The action of the cam 20 with its associated contact springs 22, 24 take over and the central apex 94 moves to the opposite side of the detent 86 where detent 86 comes to rest on the opposite cam surface of the central apex 94 thereby changing states (ie. moving the movable contact 26 from its engagement with the, for example, the second contact terminal 32 to an engagement with the first contact terminal 28).

What I claim is:

1. An alternate action push-button switch comprising a plunger, a bushing, a housing, a pawl pin, a return spring, a cam, first and second contact springs, a movable contact, first and second contact terminals, a center contact terminal and a bracket, the bushing includes a passage and an open, second terminal end, a portion of the plunger is positioned within the passage, the pawl pin being positioned within the passage, having a terminal end, bearing against the plunger and being circumscribed by the return spring, the bracket has an aperture formed therethrough, the terminal end of the pawl pin coaxially aligned with the aperture, the bracket being engaged to the bushing and covering its second terminal end, the return spring abutting the bracket, the housing including a base which is engaged to the first, second and center contact terminals, the center contact terminal having a prime free terminal and, the first contact terminal having a first terminal end and the second contact terminal having a second terminal end, the first and second terminal ends being positioned on the same horizontal plane and the prime free terminal end positioned on a horizontal plane above the first and second terminal ends, the movable contact being positioned on the prime free terminal end, the cam having an upper face and a lower surface, the lower surface having a pair of spaced blind apertures formed therein, a contact spring being mounted in each blind aperture and being against the movable contact, the upper face provides cam surfaces whereby activation of the plunger will cause the pawl pin to engage the cam surfaces shifting the movable contact from its engagement with one contact terminal end to the other contact terminal.

2. An alternate action push-button switch comprising a plunger, a bushing, actuation means, a return spring, a cam, biasing means and a movable contact, the plunger movably mounted in the bushing and engaging the actuation means, the actuation means adapted to contact the cam and the cam having the biasing means associated therewith and the biasing means engaging the movable contact, the cam having an upper face and a lower surface, the lower surface having a pair fo spaced blind apertures formed therein, one of the biasing means being mounted in each blind aperture and bearing against the movable contact, the upper face provides cam surfaces whereby activation of the plunger will cause the actuation means to engage the cam surfaces shifting the movable contact from its engagement with one contact terminal to the other contact terminal.

3. The alternate action push-button switch as set forth in claim 2 further comprises a bracket, the actuation means having a terminal end, the bushing having an open terminal end, the bracket having an aperture formed therethrough, the terminal end of the actuation means aligned with the aperture, the bracking being engaged to the bushing and covering its open terminal end, the return spring abutting the bracket and the cam abutting the bracket.

* * * * *